US005516096A

United States Patent [19]

Whiteside et al.

[11] Patent Number: 5,516,096

[45] Date of Patent: May 14, 1996

[54] METHOD AND APPARATUS FOR SECURING A FLEXIBLE SHEET TO A ROTATABLE SUPPORTING SURFACE

[75] Inventors: George D. Whiteside, Lexington; Richard A. Rosenthal, Winchester, both of Mass.

[73] Assignee: Polaroid Corporation, Cambridge, Mass.

[21] Appl. No.: 241,148

[22] Filed: May 10, 1994

[51] Int. Cl.[6] ..... B65H 5/12

[52] U.S. Cl. ..... 271/277; 271/82; 101/409

[58] Field of Search ..... 271/82, 277; 101/408, 101/409, 410, 411

[56] References Cited

U.S. PATENT DOCUMENTS

| | | | |
|---|---|---|---|
| 744,538 | 11/1903 | Halvorson . | |
| 1,519,944 | 12/1924 | Warsen . | |
| 1,843,754 | 2/1932 | Fankboner . | |
| 1,869,403 | 8/1932 | Belluche . | |
| 2,049,917 | 8/1936 | Mallina | 178/7 |
| 2,123,997 | 7/1938 | Jirousek . | |
| 2,618,702 | 11/1952 | Thompson | 178/7.1 |
| 3,637,202 | 1/1972 | Mowry et al. | 271/51 |
| 3,827,803 | 8/1974 | Shelffo et al. | 355/3 R |
| 3,865,362 | 2/1975 | Luffy et al. | 271/82 |
| 3,903,795 | 9/1975 | Suzuki | 101/409 |
| 3,918,707 | 11/1975 | Villemer et al. | 271/277 |
| 4,033,575 | 7/1977 | Fujimoto | 271/3 |
| 4,111,123 | 9/1978 | Willeitner | 101/407 |
| 4,132,403 | 1/1979 | Weisbach et al. | 271/277 |
| 4,135,198 | 1/1979 | Fujimoto | 346/138 |
| 4,138,102 | 2/1979 | Palmer | 271/3 |
| 4,183,652 | 1/1980 | Yanagawa | 355/3 |
| 4,219,272 | 8/1980 | Brückel et al. | 355/16 |
| 4,250,810 | 2/1981 | Fowler et al. | 101/410 |
| 4,357,870 | 11/1982 | Rudolph et al. | 101/246 |
| 4,501,415 | 2/1985 | Loebach | 270/60 |
| 4,517,575 | 5/1985 | Kakimoto et al. | 346/138 |
| 4,592,279 | 6/1986 | Kemmerer | 101/412 |
| 4,660,825 | 4/1987 | Umezawa | 271/277 |
| 4,807,867 | 2/1989 | Lippold et al. | 271/277 |
| 4,824,096 | 4/1989 | Fichter et al. | 271/277 |
| 4,895,073 | 1/1990 | Wieland | 101/409 |
| 4,903,957 | 2/1990 | Binder et al. | 271/277 |
| 4,905,985 | 3/1990 | Nagatani | 271/277 |
| 5,052,299 | 10/1991 | Kojima | 101/415.1 |
| 5,159,352 | 10/1992 | Ferla et al. | 346/108 |
| 5,181,466 | 1/1993 | Ono | 101/142 |
| 5,255,056 | 10/1993 | Preszler et al. | 355/211 |
| 5,324,023 | 6/1994 | Fedorjaka | 271/277 |
| 5,359,933 | 11/1994 | Blaser et al. | 101/409 |

FOREIGN PATENT DOCUMENTS

| | | | |
|---|---|---|---|
| 56-017838 | 2/1981 | Japan | B65H 5/12 |
| 0208074 | 1/1990 | Japan | B41J 13/22 |

*Primary Examiner*—H. Grant Skaggs
*Attorney, Agent, or Firm*—Leslie Payne

[57] ABSTRACT

There are method and apparatus for automatically clamping and cinching a flexible sheet medium on a rotatable supporting surface with clamping and cinching forces which independently increase as function of the rotational speed of the support surface. The clamp applies such forces to at least one edge of the sheet medium in a manner so that the sheet edge will not bend or push the sheet edge away from a pivot axis of the clamp so as to reduce sheet medium separation.

18 Claims, 6 Drawing Sheets

METHOD AND APPARATUS FOR SECURING A FLEXIBLE SHEET TO A ROTATABLE SUPPORTING SURFACE

BACKGROUND OF THE INVENTION

The present invention relates generally to securing a sheet medium onto a support surface and, more particularly, to a method of and apparatus for firmly securing a flexible film sheet medium, in a preferred wrapped position, on a rotary drum so as to allow the sheet to be imprinted.

A wide variety of sheet processing systems have been proposed for effecting clamping of a sheet medium onto a cylindrical surface of a rotatable drum. For example, in facsimile machines, computer printers, and xerographic copiers, there are requirements for releasably clamping and wrapping a sheet medium to and about a rotary drum, whereby the medium can be imprinted while the drum is rotating. In general, the rotary drums of the above devices are rotated at relatively slow speeds, for example, in the order of about 10–100 rpms. However, with the advent of high speed digital dry laser imaging processes, such as the type commercially available from Polaroid Corporation of Cambridge, Mass., USA for use in obtaining high-quality radiographic images, there is a requirement that the film or medium be printed while being rotated at high speeds, such as in the order of about 1200 to 6000 rpm so that they can produce images within as commercially accepted time frames as conventional techniques. Another requirement is that the sheet being imaged remain in a preferred wrapped position for insuring the degree of image resolution required in the medical field. For example, one consequence of a sheet being misaligned or spaced from its desired wrapped position is that the quality of the resolution can be compromised significantly. This is especially critical with, for instance, radiological images of the medical type. In this regard, if the position of the film is off by as little as about ±40 microns from the intended plane, the resulting medical images are obviously less than the quality obtainable. To better appreciate the precision required in maintaining the sheet in its desired wrapped position, it should be considered that the thickness of a human hair is about 70 microns. Thus, it is evident that even minor deviations of a sheet from its intended wrapped position may cause unacceptable medical images.

The potential for a sheet deviating from its intended wrapped condition during digital imaging of the above type becomes even more significant whenever the size of the sheet to be printed increases. This is so because the larger format film sheets must be rotated at higher speeds so that they can be imprinted with considerably more information within the same general time frame as the smaller format sheets having less information. Because of increases in rotational speeds, there are increases in centrifugal forces acting on the sheet and the clamps. This tends to create problems with the sheet separating radially due to, for example, stretch of the sheet from its supporting drum and otherwise becoming misaligned, not to mention inducing clamping performance problems. These potential adverse effects of the centrifugal forces are even more pronounced when considering the fact that the centrifugal forces increase as the square of the increase of a drum's rotational speed. Furthermore, if the film sheets bulge or otherwise separate from the drum surface irregularly, then the printing laser head, which automatically moves toward and away from the sheet during printing in an effort to maintain the laser head at its desired focal plane distance to the print surface, will not be able to move in and out fast enough to maintain such desired focal distance. As a consequence, the rendered radiological images can be less then satisfactory.

One known approach for clamping a flexible sheet of dry laser imaging film onto a cylindrical surface of a rotatable drum, so as to be imprinted by a laser, is described in commonly assigned U.S. Pat. No. 4,903,957 issued Feb. 27, 1990. This patent discloses use of leading and trailing edge clamps which are mounted axially on a rotatable drum and are sequentially operated by external cams to clamp and release both the leading and trailing edges of the flexible sheet that is to be wrapped on a rotating drum.

Another known approach for clamping dry laser imaging film sheets to a rotary drum is present in a Helios 810 Laser Imager machine. The machine produces high quality 8×10-inch format radiographic images and is commercially available from the assignee of the present application. The clamping device employed clamps leading and trailing edges of a sheet to a cylindrical surface of a rotary drum. Each clamp is centrifugally actuated and has its center of gravity on one side of its pivot axis, whereby the center of gravity will pivot outwardly in response to centripetal acceleration forces, so as to provide corresponding and significant clamping forces directly radially inwardly on the medium by the clamp's claw.

While the foregoing approaches are satisfactory, there is nevertheless a desire to improve upon clamping performance, especially in situations wherein even high rotational speeds and centrifugal forces are to be encountered, such as when printing larger format film in the order of 14×17-inches as opposed to 8×10-inch film sheets.

SUMMARY OF THE INVENTION

In accordance with the present invention, provision is made for an improved method of and apparatus for clamping flexible sheet material to a rotatable supporting device.

In one illustrated embodiment, provision is made for a method of automatically clamping and cinching a flexible sheet medium on a rotatable supporting surface with clamping and cinching forces which independently increase as a function of the rotational speed of the support surface so as to assist in a tight wrapping of the medium. Included in the method are the steps of mounting a flexible sheet medium onto a surface of a rotatable supporting surface; and, clamping first and second opposed edges of the sheet so as to wrap it on the support surface. At least one of the edges is clamped by a centrifugally operable clamp mechanism, whereby clamping forces on the sheet edge increases, as the rotational speed of the support surface increase. In addition, the method includes having the clamp apply a force to the sheet edge so that it will not bend or push the sheet away from a clamp pivot axis to thereby not cause the medium to otherwise buckle or bulge from its precision wrapped position.

In another embodiment, the method includes having a clamp apply automatically a cinching force to the medium's edge to thereby even more securely wrap the medium on the support so as to reduce the tendency of the medium to separate from its support surface under centrifugal forces.

In an illustrated embodiment, provision is made for an apparatus which includes a rotatable supporting mechanism which has a surface for supporting a medium so that it can be imprinted while being rotated by such surface. Included is a clamping mechanism mounted on the support which includes a pivotal clamp that has a center of gravity which pivots as the drum is rotated to drive the clamping edge thereof against the medium and the drum with a force which corresponds to the centrifugal acceleration of the drum. The centrifugal clamp is constructed so that it will not bend or push the medium away from the clamp's pivot axis to thereby cause the medium to otherwise buckle or bulge from its precision wrapped position.

In still another embodiment, the clamp is constructed to pull the medium's edge toward its pivot axis so as to cinch the sheet on the rotatable surface and thereby even more securely wrap the medium on the support so as to reduce the tendency of the medium to separate from its support surface.

Among the other objects of the present invention are, therefore, the provision of method and apparatus which clamp a flexible sheet medium on a rotary drum in a preferred wrapped position without the sheet misaligning or buckling during rotation.

Another object of invention is to clamp a sheet of film medium to a rotary drum in a manner whereby as centrifugal forces increase, the medium clamping forces that are applied to the edge of the sheet increase, and medium cinching forces are applied automatically to at least one sheet edge so as to even more tightly wrap it during high rotational speeds.

Still another object of the invention is to clamp a sheet of film medium to a rotary drum in a manner whereby as centrifugal forces increase, the medium clamping forces that are applied to the edge of the sheet increase and a distal clamping end of the clamp deflects inwardly toward a pivot axis of the clamp and acts to cinch the medium to a rotary drum so that the medium does not bulge or buckle.

Still another object of the invention is to clamp a sheet of film medium to a drum in a manner whereby it conforms as closely as possible to the drum's peripheral surface during laser printing.

Still another object of the invention is to clamp a sheet of film medium to a drum in a manner whereby it avoids formation of voids between the drum and the sheet of a nature which will cause a laser head to be out-of-focus during printing, whereby inaccurate printing information results.

Other objects and advantages of the present invention will become apparent from the following more detailed description thereof when taken in conjunction with the accompanying drawings in which like structure is represented by like reference numerals throughout the several views.

DETAILED DESCRIPTION

Figure 7:
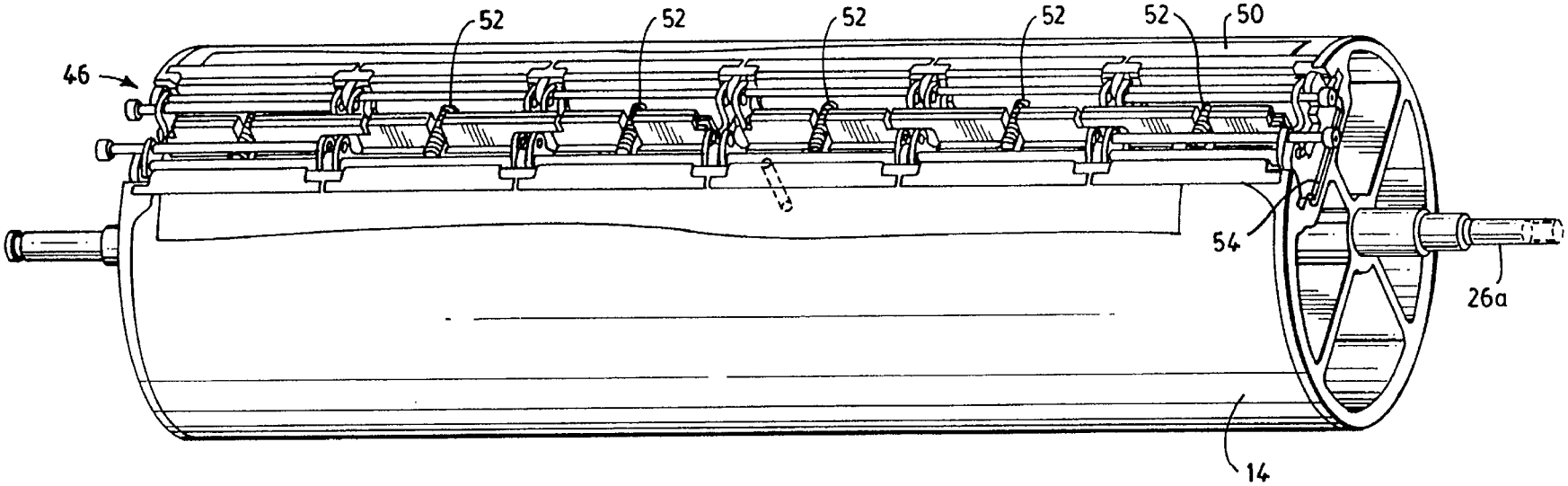
FIG. 7 is a perspective view of a drum clamp assembly showing the clamping arrangement in its assembled relationship.

Reference is made to the accompanying drawings for purposes of illustrating a preferred embodiment of an apparatus generally designated by reference numeral 10 for clamping and maintaining a flexible sheet medium 12 (FIG. 7) in a preferred wrapped position. The apparatus 10 includes a high speed rotary drum 14 upon which is the sheet is to be rotated at very high rotational speeds, such as in the order of about 1200–6000 rpm, while the sheet is being imprinted in a printer mechanism designated 16, by an axially movable laser writing mechanism 18, such as the type described in a commonly-assigned U.S. Pat. No. 5,159,352. While this embodiment is concerned with laser printing of a flexible sheet medium 12 in a printer, it will be understood that the clamping principles of this invention can have other applications. The flexible sheet 12 can be of a thermographic dry laser imaging type, such as is commercially available from Polaroid Corporation of Cambridge, Mass., USA. More specifically, the film can be like that described in commonly assigned U.S. Pat. No. 5,155,003. The sheet can have a dimension of 14×17-inches. However, this invention is not limited to such type of film medium or the noted size thereof.

Figure 1:
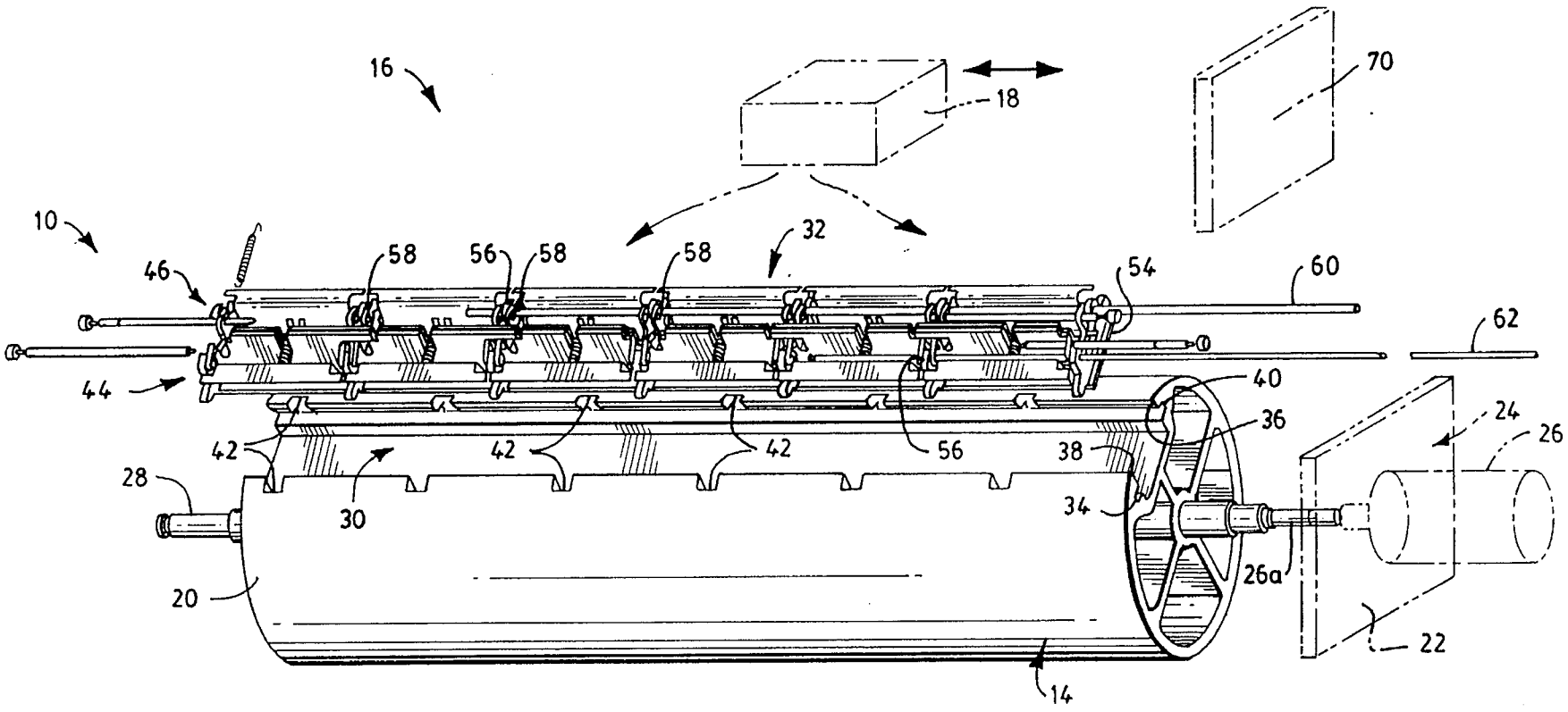
FIG. 1 is an exploded perspective schematic view of a printer mechanism illustrating the improved sheet clamping mechanism of the present invention.
Figure 2:
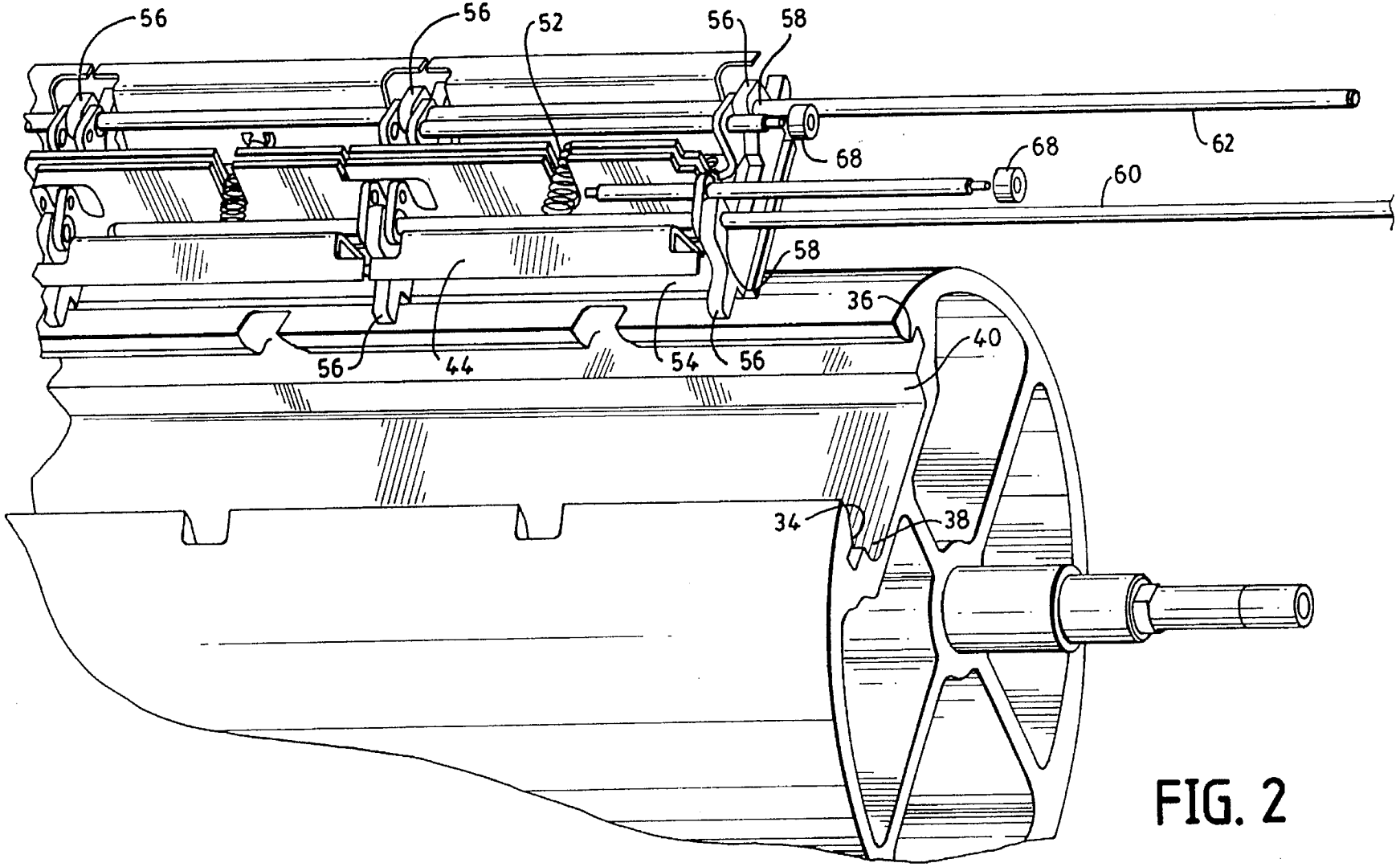
FIG. 2 is an enlarged and fragmented perspective view of the clamping assembly of the present invention.

As more clearly shown in FIGS. 1 & 2, the printer mechanism 16 includes the rotary drum 14 having a cylindrical sheet receiving and supporting surface 20 upon which the flexible sheet medium 12 is to wrapped and supported during printing. The rotary drum 14 is mounted for the noted high speed rotation on journal bearings located in endplate 22 (one of which is shown) forming part of the printer's frame assembly 24. An electric motor 26 is mounted on the frame assembly 24 and is appropriately coupled to a drum motor shaft **26*a* so as to drive the drum about its rotational axis; at the high speeds desired. The rotary drum 14 is balanced for facilitating desired high speed rotation and the cylindrical supporting surface 20 is precisely machined so that a wrapped sheet can be evenly supported in a preferred wrapped position. An encoder shaft 28 extends from the other end of the rotary drum so as to facilitate controlling angular orientations of the drum, which control operations do not form part of the present invention. The rotary drum 14 includes a clamp assembly mounting channel 30 extending along its axial extent for securely and removably receiving therein a centrifugally actuated clamping assembly 32. The mounting channel 30 is provided with a guide recess 34, 36 in each of the opposing channel sidewalls 38, 40; respectively. A plurality of axially spaced receiving notches 42 are formed along each channel sidewall 38, 40 for slidably cooperating with the centrifugally actuated clamping assembly 32**, in a manner to be described.

Figure 6:
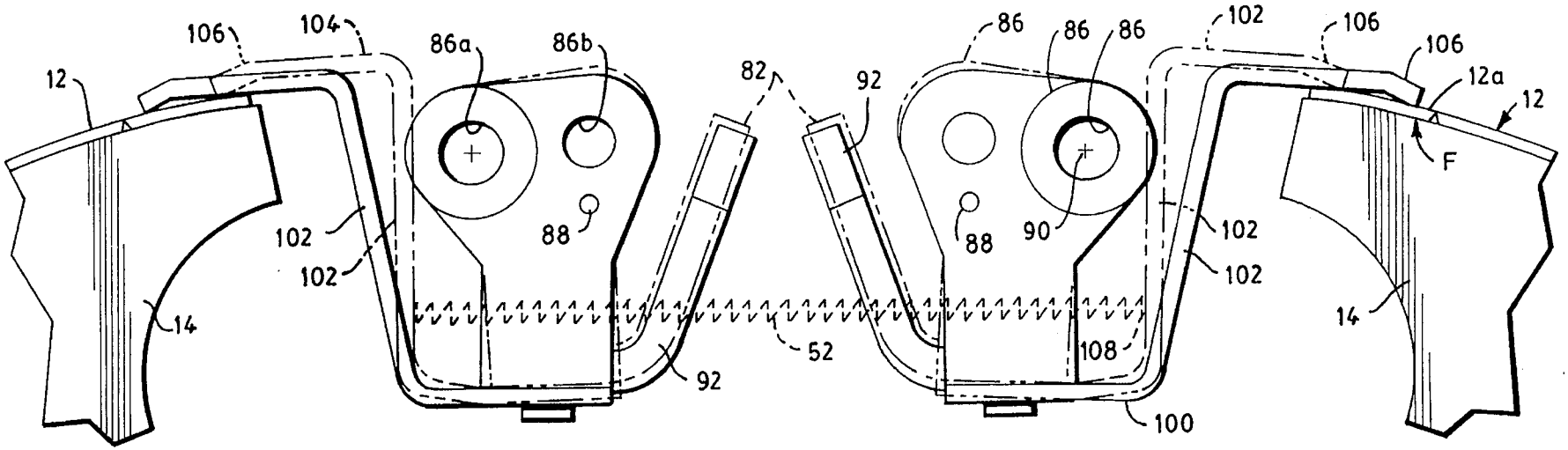
FIG. 6 is an enlarged and fragmented end view of the clamp mechanism of the present invention.

Reference is now made to FIGS. 1, 2 & 6 for describing the centrifugally actuated clamping assembly 32. Included in the clamping assembly 32 is a plurality of axially aligned and spaced apart pairs of leading and trailing edge clamps 44 and 46 for clamping leading and trailing sheet edges 48, 50; respectively. The clamping assembly 32 also includes a tension spring 52 connected to and between each pair of leading and trailing clamps 44 and 46 in order to bias them to their normally closed positions; see FIG. 7. Included in the clamping assembly 32 is a generally thin rectangular clamp baseplate 54 which extends along the length of the channel 30 and can be fixedly attached to the rotary drum 14. A plurality of vertical supports 56 are attached to the baseplate 54 in axially spaced apart relationship to each other to support therebetween a pair of the leading and trailing clamps 44 and 46. The vertical supports 56 have a pair of openings 58 (FIG. 1). Each opening 58 is located in a lateral ear **58*a* and removably receives therein an elongate pivot shaft 60, 62; respectively, for pivotally supporting the clamps. Each of the support ears 58*a* can slide within a respective guide recess 34,36 to retain the clamp assembly and cooperates with the notches 42 to retain the clamp assembly. The pivot shafts 60, 62 are adapted to pivotally mount each of the leading and trailing edge clamps 44, 46; respectively, to the vertical supports. Each of the outermost axial pair of clamps is adapted to cooperate with a cam follower shaft 66. Each of the shafts 66 has a cam roller 68 at its distal end which protrudes beyond the end of the rotary drum 14. The cam rollers 68 are to be selectively displaced radially inward relative to the drum's axis upon engagement and downward movement by a cam mechanism generally designated by reference numeral 70**.

Figure 3:
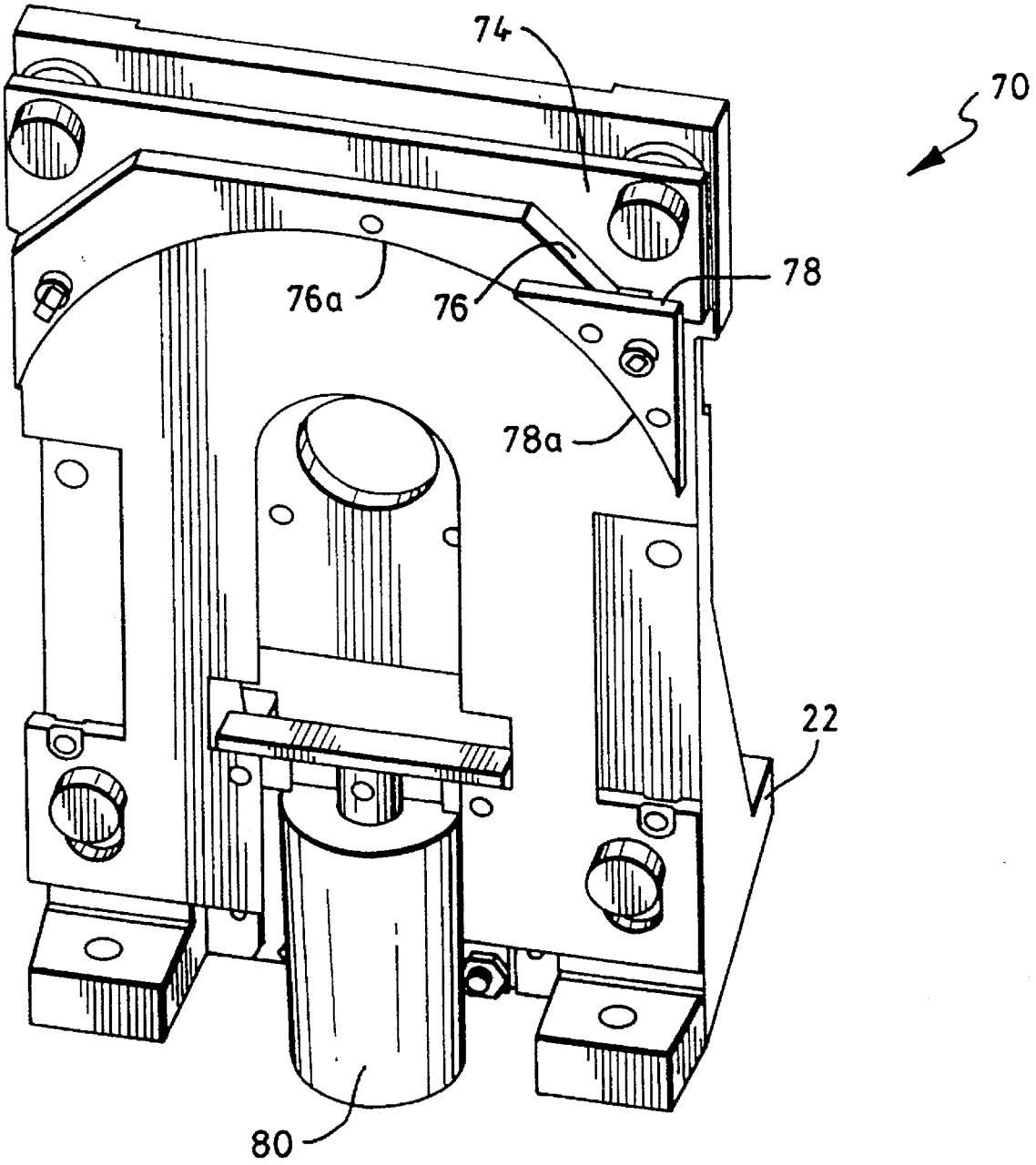
FIG. 3 is a perspective view of a drum endplate assembly carrying a cam mechanism.

There is a camming mechanism 70 located at each end of the rotary drum 14, only one of which is shown in FIGS. 1 and 3, for engaging the axial cam rollers 68 in a manner to be described. In this regard, the camming mechanism 70 is mounted on the machine endplate assembly 22 which, as noted, is apertured and journalled to rotatably receive one end of the drum shaft. A slider 74 is mounted on the endplate assembly 22 for vertical movement between camming and non-camming positions. The slider 74 has mounted thereon an arcuate camming member 76 having a camming surface 76*a* which is adapted to engage one set of the cam rollers 68 associated with the leading edge clamps. A camming member 78 is fixedly mounted on the camming member 76 as shown in FIG. 3. The camming member 78 has an arcuate camming surface 78*a* which is adapted to engage the other set of cam rollers 68 associated with the trailing edge clamps. A solenoid assembly 80 is coupled to the slider 74 and is actuated to vertically move the latter between its camming and non-camming positions. It should be noted that the camming surfaces are in different planes and the cam rollers of the leading and trailing clamps are spaced at appropriately different axial distances from the end of the drum. This allows the camming surfaces 76*a*, 78*a* to independently engage their respective clamping rollers 68 so that the leading and trailing edge clamps are operated independently of each other. It will be understood, that the opposite terms leading and trailing are relative and that th opposite terms can be applied to these clamps. Such movement will cause the clamps to pivot from their clamping position shown to their open condition (not shown). Further in this regard, the drum will be stopped at angular positions to achieve the foregoing independent actuation. The camming mechanism 70 does not, per se, form an aspect of the present invention, since other arrangements can be provided for opening the leading and trailing edge clamps independently of each other. It should be noted that whenever the cam mechanism 70 is in the non-camming position, the clamp springs 52 are operative to drive both the leading and trailing clamps to their normally closed or clamping positions.

Figure 4:
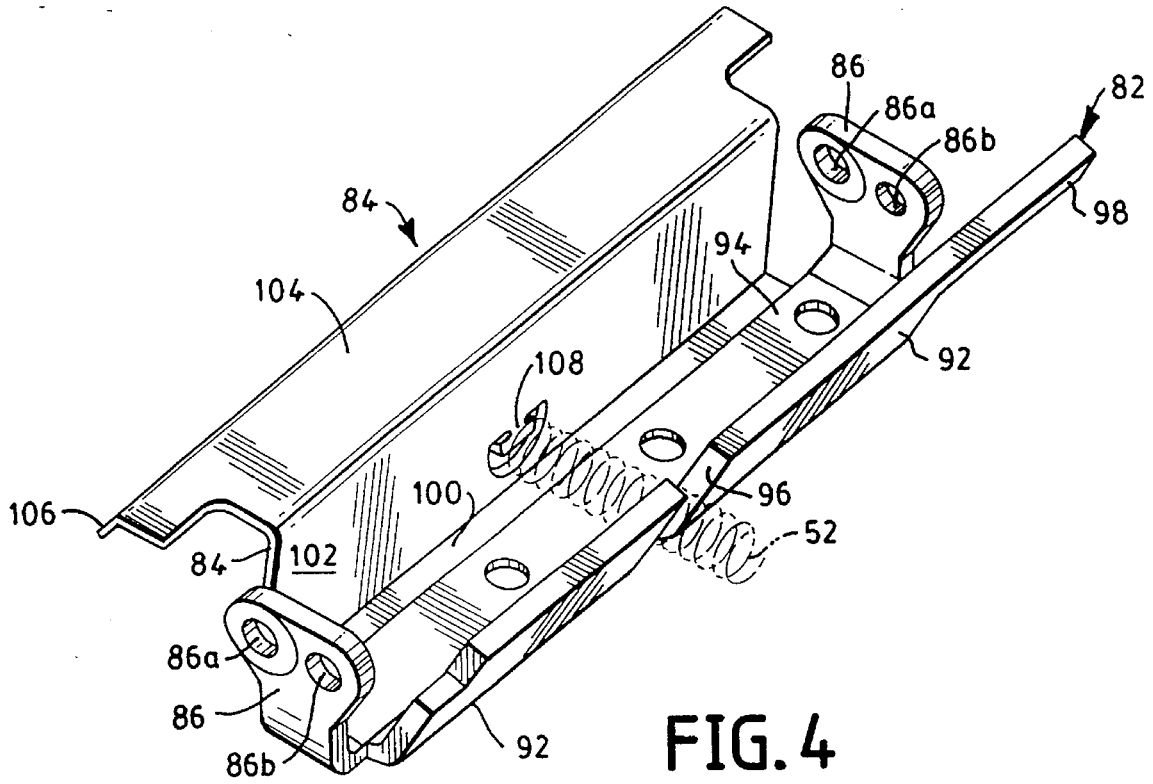
FIG. 4 is a perspective view of a clamp mechanism of the present invention.
Figure 5:
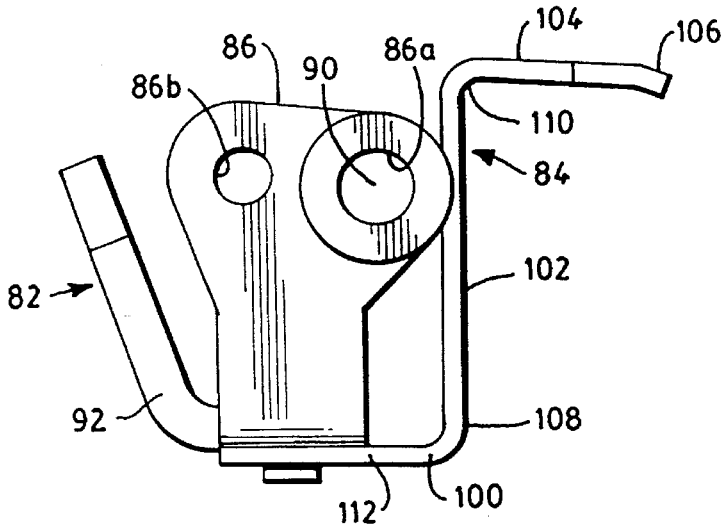
FIG. 5 is an end view of the clamp shown in FIG. 4.

Reference is now made to FIGS. 4–6 for describing the clamps. In the illustrated embodiment, each clamp of every pair is the same as the other clamp of the same pair but this need not be the case. However, the middle pair of clamps is structured differently from those at axial ends for reasons which will be described. Each axial end pair of clamps, only one is illustrated for purposes of clarity, presents a counterweight segment 82, a clamping segment 84, and a supporting segment 86 which extends upwardly from axial ends of the counterweight segment. The supporting segment 86 has aligned shaft openings 86*a* and cam shaft openings 86*b*. Since these are centrifugally actuated clamps, it should be noted that whatever clamp configurations and materials are selected, consistent with the teachings of this invention, the center of gravity of each clamp is spaced from the clamp's pivot axis 90 to provide the desired clamping forces. In this regard, the further the clamp's center of gravity is from its pivot axis, the higher the clamping forces which are exerted. Also, higher clamping forces can be generated with heavier clamps, however, heavier clamps have the disadvantage of adding to inertia problems of rotating a drum at the high speeds desired for achieving low printing cycle times.

With continued reference to FIGS. 4–6, the counterweight portion 82 is a relatively rigid and elongated member made of, for instance, steel and having a generally inclined and upstanding portion 92 and at a proximal end a flat base 94. The base 94 has integrally formed at its opposite ends the segments 86. The inclined portion 92 also has a centrally located recess 96 which accommodates the spring 52 so that the latter can move freely relative to the former during pivoting. In addition, the inclined portion 92 has an axial tab 98 which is arranged to contact and drive the adjacent clamp to its open condition. In this manner, the endmost clamp will drive its adjacent innermost clamp by the tab 98. In turn, the adjacent innnermost clamp also has a tab 98 which engages and opens the middle clamp. Thus, all the clamps will be operated to open when the camming mechanism engages the cam roller associated with a particular set of clamps in response to actuation by the camming mechanism 70. The inclined portion 92 of one clamp will not, however, contact the inclined portion 92 of the adjacent clamp of its pair during pivoting movement, see FIG. 6.

Reference is made to the clamping segment 84 which has a base beam 100, an upright deflecting beam portion 102, and a claw or sheet engaging portion 104 having a downwardly directed claw tip 106. The claw tip 106 is dimensioned to extend over a tab portion 12*a* of the sheet. A recessed tab 108 is present in the upright position 102 and has one end of the spring 52 attached to it. The other end of the spring is attached to a tab which is on the other clamp of the pair, see FIG. 6. The sheet clamping segment 84 can be made of a variety of materials and in this embodiment is made of steel. The segment 84 is dimensioned to be relatively lighter than the counterweight segment 82. Whatever materials and dimensions are selected for the clamping segments should allow it to deflect relative to the counterweight segment when subjected to the clamping forces applied to its claw, as will be described. Another advantage of the clamp segment being lighter than the counterweight segment is that it is easier to space the clamp's center of gravity farther from the pivot 90.

As earlier indicated, this invention makes provision for the clamping segment 84 deflecting toward the pivot 90, as shown in FIG. 6. This deflection is caused by the reaction forces F of the drum being applied on the claw tip 106 which reaction forces are in opposition to the clamping forces caused by the centrifugal forces acting at the center of gravity of the clamp. It may then be seen that the centrifugal forces cause the claw to bear against the sheet and the drum. Specifically, the base 100 and the upright 102 deflect as seen in FIG. 6. Such deflection is effective to displace the claw tip and thereby the clamped sheet edge toward the pivot 90. This displacement acts to cinch or even more tightly wrap the sheet on the drum and counteracts the tendency of the sheet to otherwise separate and buckle relative to the surface 20. The cinching force generated can be selected to maintain the sheet in its preferred wrapped position relative to the laser head. The advantages of this are that the cinching inhibits the dynamic centrifugal clamping forces acting on the clamp in such a manner as would otherwise cause the claw to deflect such that tip and sheet moves away from the pivot to cause the sheet to thus deviate unacceptably from its precision wrapped position. It will be appreciated that the clamping forces of the claw increase as the centripetal acceleration forces increase and drive the center of gravity about the axis 90 in the clamping direction. Accordingly, the reaction forces increase as the centrifugal forces of the clamp increase due to drum speed increases. Thus, the reaction forces F increase and, therefore, so do the cinching forces since the reaction forces cause the deflection. This is highly advantageous since the cinching forces increase as the need for them increases, but also automatically. If it were not for the noted deflection, it has been determined that the claw portion would tend to push or displace the sheet edge away from the pivot axis. Consequently, the sheet would generally buckle or bulge in an irregular fashion from its wrapped position.

In this embodiment, the clamping portion is flexible at bend 108 which is positioned beneath the flexible portion at bend 110 of the claw 104 by an amount which permits the deflection of the clamping portion for achieving the cinching functions noted. The base 100 is flexible at bend 110 that allows the base to deflect upwardly in a manner which allows the tip 106 to displace and cinch the sheet. By controlling the total deflection of the components of the clamping portion, the amount of the displacement of the tip 106 can be controlled. For example, the clamps can be made so that the portion 102 need not deflect, and that all the deflection for cinching comes from the base 100. Alternatively, the base can be rigid and the total amount of deflection can be controlled by the deflection of the portion 102. In addition, the amount of cinching can be controlled by the height of portion 102. Thus, the cinching can be regulated by contolling the geometry of the portions of the clamps as well as the mechanical properties of their components. Another advantage is that the automatic cinching can be accomplished by a relatively lightweight and compact configured clamps. The lightweight and compact advantages are highly advantageous for drums required to rotate at high speeds. If the centrifugal clamps were made heavier and larger in an effort to resist the outward deflection of the claw and to otherwise increase clamping forces then the clamps would be significantly heavier and this would therefore tend to make the speed up and slow down time of the drum commercially unacceptable. Furthermore, larger clamps would increase the circumferential deadtime during which time the laser is unable to print as it rotates over the clamps.

The present invention may be embodied in other specific forms without departing from the spirit or essential characteristics thereof. The present embodiments are, therefore, to be considered in all respects as illustrative and not restrictive. The scope of the invention being indicated by the appended claims rather than by the foregoing description and all changes which come within the meaning and the range of equivalency of the claims are therefore intended to be embraced therein.

We claim:

1. A method of securing a flexible sheet medium on a rotatable supporting surface with securing forces which increase as the rotational speed of the supporting surface increases so as to assist in maintaining a preferred wrapped position of the sheet on the surface; said method comprising the steps of:

mounting a flexible sheet medium onto a surface of a rotatable supporting surface; and, applying securing forces to opposite ends of the sheet wherein at least one edge of the sheet has the securing force applied directly thereto by a centrifugally operable clamping mechanism having a clamp with a deflectable clamping segment between a pivot axis and its clamping, tip which engages the sheet such that securing forces increase on said at least one edge as the rotational speed of the support surface increases and the clamping mechanism causes the sheet edge to remain clamped to the supporting surface in a manner that does not push the at least one sheet edge away from the pivot axis, so as to maintain the sheet in a preferred wrapped position.

2. A method of clamping and cinching a flexible sheet medium on a rotatable supporting surface with clamping and cinching forces which increase as the rotational speed of the support surface increases, said method comprising the steps of:

mounting a flexible sheet medium onto a surface of a rotatable supporting surface;

securing opposite edges of the sheet medium to the support surface;

applying a clamping force directly to at least one of the edges which increases as the rotational speed of the support surface increases; and, applying a cinching force to the one edge which increases as the speed of the support surface increases; whereby the clamping and cinching forces reach levels which resist the sheet medium tending to radially separate from the support surface as well as bulge in a manner which would disrupt a preferred wrapped position of the sheet.

3. A method as set forth in claim 2 wherein the cinching and clamping forces increase automatically as the rotational speed of the support surface increases.

4. A method as set forth in claim 2 which further includes a step of clamping and cinching an edge of the sheet medium opposite the one edge in a manner which increases both the clamping and cinching forces thereon as the speed of the rotating surface increases to thereby reduce any tendency of the medium to radially separate or bulge from the intended preferred wrapped position.

5. A method of clamping and cinching a flexible sheet medium on a rotatable supporting, surface with clamping and cinching forces which increase as the rotational speed of the support surface increases, said method comprising the steps of:

mounting a flexible sheet medium onto a surface of a rotatable supporting surface:

securing opposite edges of the sheet medium to the support surface;

applying a clamping force directly to at least one of the edges which increases as the rotational speed of the support surface increases; and, applying a cinching force to the one edge which increases as the speed of the support surface increases; whereby the clamping and cinching forces reach levels which resist the sheet medium tending to radially separate from the support surface as well as bulge in a manner which would disrupt a preferred wrapped position of the sheet;

wherein said cinching force is applied by a centrifugally actuated clamp including a deflectable portion having a distal tip which engages the medium, wherein the deflectable portion deflects toward a pivot point of the clamp to thereby cause the tip to cinch the medium on the support surface as the rotational speed increases.

6. A method as set forth in claim 5 wherein the deflectable portion has a pivot on the clamp and the amount of cinching force is a function of the distance the distal tip is from the pivot of the deflectable portion.

7. A method as set forth in claim 6 wherein the amount of cinching force is increased by increasing the distance the distal tip is from the pivot axis of the deflectable portion.

8. An apparatus for securing a flexible sheet medium on a rotatable supporting surface with securing forces which increase as the rotational speed of the supporting surface increases so as to maintain a precision wrapping of the medium on the surface; said apparatus including:

means operable for rotating and for providing a rotatable support surface for supporting a flexible sheet medium thereon;

means for applying securing forces to the sheet so as to selectively maintain the sheet in a precision wrapped position;

said applying means including a centrifugally operable clamping mechanism having a clamp with a deflectable clamping segment between a pivot axis and a clampings tip thereof which engages the sheet such that the deflectable clamping segment deflects whereby the securing forces are applied directly to at least one edge of the sheet and which increase as the rotational speed of the support surface increases, such that said applying means cause the sheet edge to remain clamped to the supporting surface and will not bend or push the sheet edge away from the pivot axis during rotation so that the sheet is unacceptably displaced from the precision wrapped position.

9. An apparatus for clamping and cinching a flexible sheet medium on a rotatable supporting surface with clamping and cinching forces which increase as the rotational speed of the support surface increases and which maintain the sheet in a predetermined wrapped position, said apparatus comprising:

means operable for rotating and for providing a rotatable support surface for supporting a flexible sheet medium thereon;

means for clamping first and second edges of the sheet medium to said support surface;

means for applying a clamping force to at least one of the edges which increases as the rotational speed of said support surface increases; and, means for applying a cinching force to the one edge which increases as the speed of said support surface increases;

said means for applying cinching and clamping forces applies such clamping and cinching forces so that they reach levels which minimize any tendency for the sheet medium to radially separate or bulge from said support surface during rotation in a manner which would cause unacceptable displacement of the sheet from its preferred wrapped position.

10. The apparatus of claim 9 wherein said means for applying said cinching and clamping forces are operable to increase automatically as the rotational speed of said support surface increases.

11. The apparatus of claim 9 wherein said means for clamping and cinching are operable to clamp and cinch an edge of the sheet medium opposite the one edge in a manner which increases both the clamping and cinching forces thereon as the speed of said rotating surface increases to thereby reduce any tendency of the medium to radially separate or bulge in an unacceptable manner from its preferred wrapped position.

12. The apparatus of claim 11 wherein said means for applying cinching forces includes a centrifugally actuated clamp mechanism having a deflectable portion comprising a distal tip which engages the sheet, wherein said deflectable portion deflects toward a pivot axis of said clamp mechanism so as to thereby cause said tip to cinch the sheet on said support surface as the rotational speed of said support surface increases.

13. The apparatus of claim 12 wherein said deflectable portion has a pivot axis on said clamp and the amount of cinching force is a function of the distance said tip is from said pivot axis of said deflectable portion.

14. The apparatus of claim 12 wherein said applying means includes a pair of clamping mechanisms, each one of said mechanisms being attached to said rotatable supporting means and extending generally along the axial extent thereof and one being adapted to releasably clamp a leading edge of the sheet medium and the other being adapted to releasably contact a trailing edge of the sheet medium.

15. The apparatus of claim 14 wherein there is further included means for biasing said leading and trailing clamping mechanisms to their closed or clamping positions.

16. Apparatus for securing a flexible sheet medium on a rotatable supporting surface; said apparatus comprising:

a rotatable drum which has a generally cylindrical surface upon which a sheet medium is to be wrapped for being imprinted;

centrifugally actuated clamping means mountable on said drum and being operable for pivotal movement on said rotatable drum and having a center of gravity which is laterally offset from a pivot axis of said clamping means;

said clamping means having a sheet clamping portion with a distal end portion, said end portion directly clamps a sheet medium to said support surface as said clamping means is pivoted about the axis to a clamping position;

said sheet clamping portion also being constructed of flexibly resilient material so that as said clamping portion clamps a sheet medium with greater force as a result of increasing centrifugally actuated forces, said clamping portion deflects and causes said distal end portion to move toward the pivot axis of said clamping means so as to apply a cinching force to the sheet which maintains the sheet medium in its intended secured position on said support surface.

17. The apparatus of claim 16 wherein said clamping portion is pivoted relative to said clamping means and the amount of cinching force applied is a function of the distance said distal end is from the pivot axis of said clamping portion.

18. The apparatus of claim 17 further including means on said drum for normally biasing said clamping means and said clamping portion to its closed position.

* * * * *